US005876261A

United States Patent [19]

Bach et al.

[11] Patent Number: 5,876,261

[45] Date of Patent: Mar. 2, 1999

[54] BUILDING SET FOR A TOY BUILDING

[75] Inventors: Erik Bach; Kaj Svejstrup Mikkelsen, both of Billund; Carsten Peter Michaelsen, Vejle; Philip Marshall Kushner, Greve, all of Denmark

[73] Assignee: INTERLEGO AG, Baar, Switzerland

[21] Appl. No.: 752,536

[22] Filed: Nov. 20, 1996

[30] Foreign Application Priority Data

Nov. 20, 1995 [DK] Denmark ..... 1298/95

[51] Int. Cl.[6] ..... A63H 33/04; A63H 33/10

[52] U.S. Cl. ..... 446/105; 446/108; 446/110; 446/116; 446/120; 446/476

[58] Field of Search ..... 446/85, 105, 110, 446/117, 118, 120, 127, 108, 111–113, 116, 476, 478

[56] References Cited

U.S. PATENT DOCUMENTS

| | | | |
|---|---|---|---|
| 707,446 | 8/1902 | Nentwig | 446/110 |
| 1,870,978 | 8/1932 | Wolfe | 446/105 |
| 3,132,443 | 5/1964 | Kuhn | 446/105 |
| 3,902,291 | 9/1975 | Zucht | 446/105 |
| 5,036,634 | 8/1991 | Lessard et al. | 52/79.1 |

FOREIGN PATENT DOCUMENTS

| | | | |
|---|---|---|---|
| 1298281 | 5/1962 | France | 446/116 |
| 2516806 | 5/1983 | France | 446/110 |
| 100283 | 7/1935 | United Kingdom | 446/110 |
| 1042413 | 9/1966 | United Kingdom | 446/110 |

*Primary Examiner*—Robert A. Hafer
*Assistant Examiner*—Laura Fossum
*Attorney, Agent, or Firm*—Kane, Dalsimer, Sullivan, Kurucz, Levy, Eisele and Richard, LLP

[57] ABSTRACT

A building set for a toy building comprising a number of building modules (1) which each defines a space, said building modules (1) being so designed that they may be stacked or arranged next to each other as desired for the construction of single- or multi-storey toy buildings, and having means (6,7) for releasably engaging with one or more wall elements (5) in the sides of the building modules (1) irrespectively of the mutual positioning of the building modules (1). Since the columns (3) support girders (4) which define the periphery of the top plane of the building modules, said girders (4) being so arranged that unimpeded access to the building module interior (1) is provided, it is now possible to construct toy buildings with more different plan arrangements compared to the prior art without impeding the access to the building module interiors.

11 Claims, 2 Drawing Sheets

BUILDING SET FOR A TOY BUILDING

The present invention relates to a building set for a toy building and comprising a number of building modules which each defines a space, said building modules being so designed that they may be stacked or arranged next to each other, side by side, as desired to construct single- or multi-storey toy buildings, and having means for releasably receiving one or more wall elements in the sides of the building modules irrespectively of the positioning of the building modules relative to each other.

Such building sets, which are primarily useful e.g. for doll's houses that are conventionally inseparable framed structures without the option of rearranging the positions of the individual rooms in the doll's house, provide improved flexibility and an increased play value since the individual building modules of these prior art doll's houses may be used alone or in combination for the construction of single- or multi-storey doll's houses.

Moreover, compared to the commonly known building sets for the construction of single- or multi-storey toy buildings, these prior art doll's houses distinguish themselves in featuring wall elements which are removable irrespectively of the positioning of the building modules relative to each other, whether the individual building modules are stacked on top of each other or arranged side by side, cf. the teachings of e.g. in U.S. Pat. No. 1,706,696, U.S. Pat. No. 3,002,315 and U.S. Pat. No. 3,890,738.

Thus, the known doll's house consists of two plates which constitute the floor plane and the ceiling plane, respectively, of the individual building module. The two plates are spaced apart by means of columns which are provided with lateral grooves for releasably receiving wall elements in the building module. These grooves are arranged in such a manner that the releasable wall elements may exclusively be removed from the individual building module from the inside.

It is the object of the present invention to provide a building set for a toy building of the type described in the introductory part which provides the same building possibilities as known from the prior art doll's house construction that consists of individual building modules. Moreover the building set is intended to increase the number of options available for constructing toy buildings with different plan arrangements by providing the option of constructing single- or multi-storey toy buildings where walls may be established in all outer walls in a ground plan. Additionally, any partition walls which separate the individual rooms in a ground plan should also be freely removable and fittable without ensuing demolition of the basic construction of the building. These possibilities should of course be established without preventing or making it difficult to play with dolls and furniture in the individual building modules.

According to the invention as claimed in claim 1, this is obtained by providing the top portion of the building modules with a grating structure having a number of columns which support girders which define the upper periphery of the top plane of the building modules, said girders being arranged to provide unimpeded access to the building module interior from above.

The fact that the building module interiors are accessible from above allows for the construction of multi-storey toy buildings where the lower storeys may be open laterally by one or several of the wall elements being removed from the side of the building modules in the relevant storeys. However, the top storey may be provided with wall elements all around without the access to play with furniture and dolls in this storey being prevented. The individual multi-storey doll's house will thus have a more finished and authentic appearance since this top storey may be completely surrounded by walls.

Moreover, the building set according to the invention provides the option of constructing toy buildings in one storey with different plan arrangements. Thus, according to the invention it is possible to mount wall elements on all the outer sides of the toy building without impeding access to the toy building interior. At the same time wall elements which serve as partition walls between the individual building modules are freely removable and fittable which allows for variations in the room dimensions and plan arrangements in such single-storey toy building.

Claims 2 and 3 describe convenient embodiments of the present invention where the individual building modules are provided with coupling means arranged for mutual horizontal positioning and securing of the individual building modules that are stacked on top of each other or arranged side by side, respectively. Thus, by interconnecting the individual building modules, a stable toy building is produced.

Claim 4 describes a particularly convenient embodiment where the individual building modules are provided with a bottom plate element on which the grating structure is arranged. Thus, this bottom plate element constitutes the floor plan in the individual building module. Thus, the bottom plate element has a bracing function relative to the grating structure, and at the same time the need for an independent floor plate for mounting in the grating structure is eliminated, which floor plate was always to be used in all conditions.

In principle, the grating structure which forms the columns and the girders on the building modules may he in the form of a solid structure. However, claim 5 describes a convenient embodiment where the grating structure consists of rod elements which are interconnected by coupling means with a mutual holding force. Hereby a grating structure is obtained which is relatively simple to manufacture and at the same time obviates the need for a large packaging for the storage and transport, since the individual rod elements are less space-intensive than a fixed grating structure.

Claim 6 defines a convenient embodiment where the coupling means for individual coupling of the rod elements and bottom elements to each other possess a coupling force which by far exceeds the coupling force obtained with the coupling means for positioning the building modules relative to each other. Hereby it is ensured with a high degree of certainty that the individual building module does not separate upon rearrangement of the building modules relative to each other.

In this connection, claim 7 describes how the coupling means for interconnecting the rod elements and the bottom plate element consist of unreleasable snap locks or snap locks which are difficult to release.

A further convenient embodiment is described in claim 8 where the coupling means for coupling of She rod elements to each other are arranged a distance from the corners formed by the grating structure. This reduces the momentum load influencing the coupling means between the rod elements by deformation of the grating structure, thereby increasing the stability and strength of the grating structure substantially.

The coupling means for interconnecting the rod elements are provided by either the columns or the girders in the grating structure having at their one end two laterally protruding rods, the extreme ends of which feature coupling means for engaging with another rod element. This means that the number of couplings in each corner of the grating structure is reduced by one, which further contributes to the stability and strength of the grating structure.

The means for releasably receiving the wall elements in the sides of the building modules may, as defined in claim 10, conveniently consist of coupling means arranged laterally on the columns thereby profiting from the lateral flexing flexibility of the columns to secure the wall elements.

A further preferred embodiment is given in claim 11 where the means for releasably receiving the wall elements in the sides of the building modules are arranged in such a manner that the wall elements may be removed from the inside as well as the outside relative to the individual building module. This means that during the construction of multi-storey toy buildings, walls may be fitted all around the toy building when the toy building is not used for play. Hereby a toy building results with outer walls on all sides when not in use, and the walls may subsequently be removed as soon as the toy building is played with again.

Moreover, the means for receiving the wall elements may be so designed, e.g. symmetrically, that the individual wall element may optionally be used with an inwardly or and outwardly facing facade when received by the sides of the building modules.

The invention will now be described in further detail with reference to the drawings, wherein.

Figure 1:
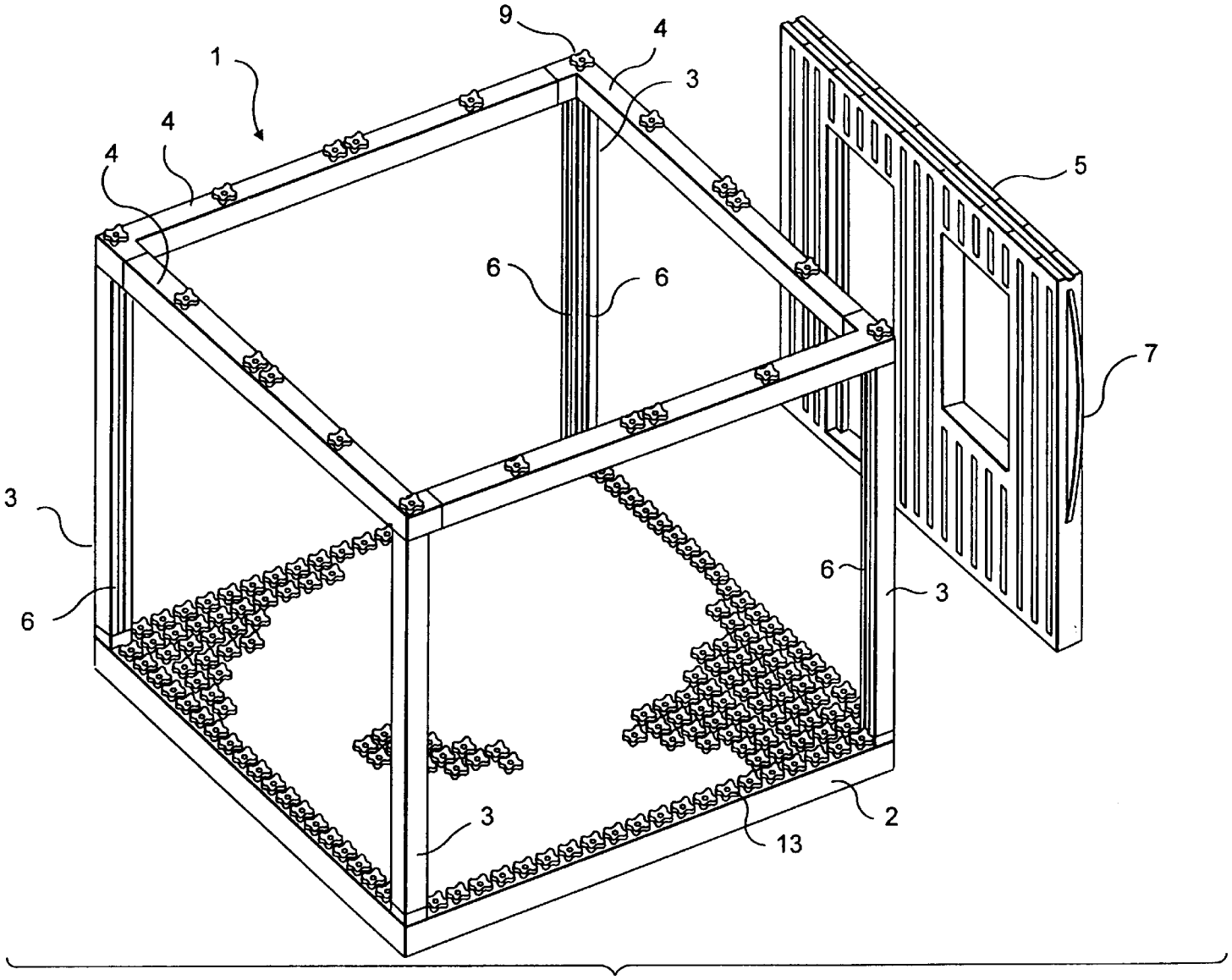
FIG. 1 is an inclined top view of a building module according to the invention.

Thus, FIG. 1 illustrates a building module 1 for the construction of toy buildings. As shown the building module 1 comprises a bottom plate 2 on which a grating structure is erected which consists of columns 3 and girders 4 which cooperate to define a space for the building module 1. By arranging such building modules 1 next to each other or stacking them on top of each other, more or less complex toy buildings may be constructed which may have one or more storeys and have different plan arrangements.

FIG. 1 further illustrates a wall element 5 which is provided laterally with respective tongues 7 whereby the wall element 5 may be introduced between the columns 3, since these columns yield and allow the tongue 7 to engage with the groove 6 on the column 3.

Since the tongue 7 on the wall element 5 is arranged centrally between the facades on the wall element 5 and since the corresponding grooves 6 on the column 3 are also arranged centrally on the lateral surface of the columns, the wall elements 5 may be oriented as desired with a given facade facing outwards or inwards relative to the building module.

As will appear from FIG. 1, the building module 1 is upwardly open and therefore furniture and dolls may be played with in the building module 1 whether or not wall elements 5 are mounted all around the building module 1. In practice, this means that if a single-storey toy building is constructed from a number of building modules 1, wall elements 5 may be fitted all around the building modules as desired without the access to play in the individual rooms in the toy building being impeded.

Of course, if the building modules 1 are stacked on top of each other the access from above will be more or less reduced. However, in that situation it is possible with the invention to remove wall elements 5 from the building modules 1 whereby access to the toy building from the side is ensured.

As will appear, the building modules 1 according to the present invention thus provide many different play options.

The girders 4 are provided with particular coupling studs 9 arranged for frictional interconnecting with recesses (not shown) on the underside of the bottom plate 2, thereby allowing the building modules 1 to be stacked on top of each other and secured horizontally relative to each other by means of the coupling studs 9.

The bottom plate 2 is also provided with coupling studs 13 which may be used for interconnecting individual bottom plates by means of a not shown coupling element. The coupling element is not shown since it may in principle consist of any element which is provided on its underside with recesses that may be interconnected with the coupling studs 13.

Figure 2:
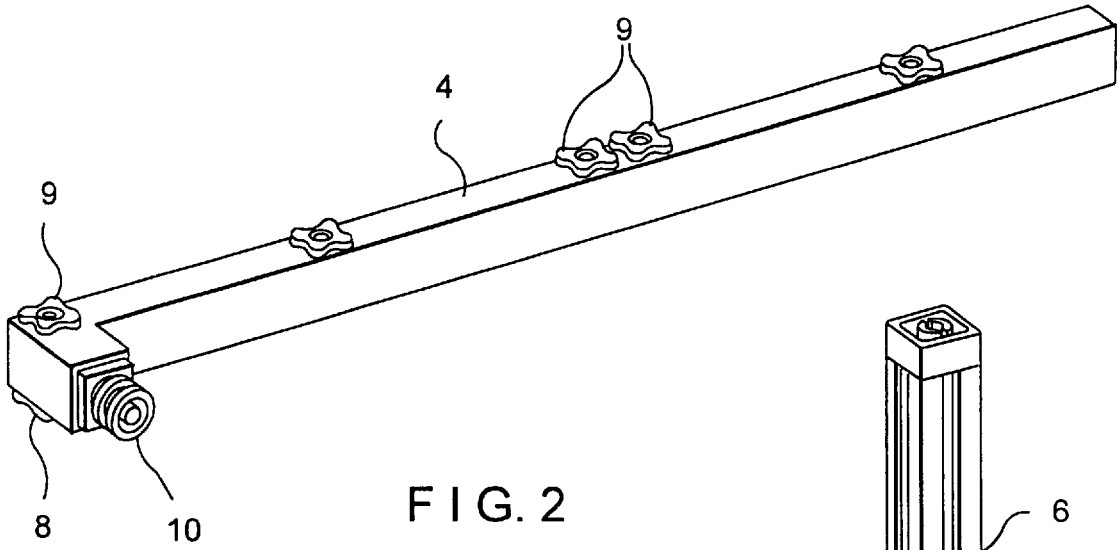
FIG. 2 is an inclined top view of a girder for the building module according to claim 1.

FIG. 2 is now referred to which illustrates a girder 4 that may conveniently be so designed that its one upper end is provided with coupling studs 8,10 which protrude sideways and where the one coupling stud 8 may be introduced into the opposite end of a corresponding girder and where the other stud 10 may be introduced at the top of a column 3. Since the girder hereby constitutes the corners of the building module 1, too, the number of components in the building set is reduced while simultaneously a more rigid structure is provided, all things being equal.

In this construction, the coupling studs 8,10 should be so designed that the coupling force obtained when assembling the individual elements which constitute the building module 1 is strong enough to ensure that e.g. the girders arc not drawn apart when the wall elements 5 are fitted into the building module.

Figure 3:
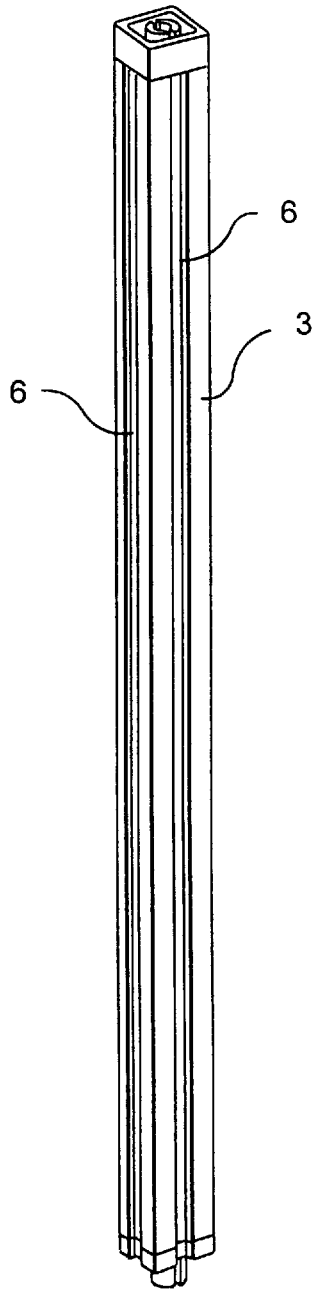
FIG. 3 is an inclined top view of the building module according to claim 1.

The column 3 for the building module 1 is shown in FIG. 3 which illustrates how this column 3 has grooves 6 on two sides for receiving the tongue 7 on the wall element 5. The column 3 being, as shown in FIG. 3, primarily in the form of an elongated profile, it is extremely simple to manufacture the column by extrusion.

It is obvious that the person skilled in the art could point to a number of different embodiments of the invention exemplified in the figures as a preferred embodiment. Thus, the building modules according to the invention may have different ground plans and dimensions, and the same applies to the wall elements 5 which may be provided with doors, windows and the like.

We claim:

1. A building set for a toy building, said toy building set comprising:

one or more wall elements;

one or more building modules each of which defines a space, said building modules each comprising a self supporting grating structure having a rectangular bottom plane defined by an outer periphery of one of said one or more building modules, and a top plane having the same size as the bottom plane, said rectangular bottom and top planes being spaced apart by columns that extend between corresponding corners of the bottom and top planes at the periphery thereof, the bottom plane being defined by a bottom plate having a top surface from which said columns extend, the grating structure including support girders which extend around the periphery of the top plane of the building modules, the support girders arranged such that there is unimpeded access to the space from above, wherein the columns of the building modules have side areas with means for releasably receiving the wall elements in the side areas of said columns when the building modules are fully assembled and irrespectively of said one or more building modules relative to each other; and wherein said one or more building modules are designed such that a underside of the bottom plate of one of said building modules can by stacked on the support girders of another of said building modules, and further designed such that two or more of said building modules can be arranged horizontally directly adjacent each other, the design of building modules allowing for the construction of single- or multi-story buildings with a variety of plan arrangements.

2. A building set according to claim 1, wherein the girders are provided with coupling studs for interconnecting with recesses on the underside of the bottom plate, allowing the building modules to be stacked and secured vertically relative to each other.

3. A building set according to claim 2, wherein the bottom plate is provided with coupling studs for interconnecting individual bottom plates horizontally by means of a separate element, said separate element having on its underside recesses for interconnecting with the coupling studs on the bottom plate.

4. A building set according to claim 2, wherein the columns and girders consist of rod-shaped elements, wherein coupling means are arranged for interconnecting the columns and girders, and wherein bottom plate coupling means are provided for connecting the columns to the bottom plate.

5. A building set according to claim 4, wherein the coupling means for interconnecting the rod-shaped elements and the bottom plate coupling means have a coupling force which exceeds the coupling force obtained with the coupling studs for interconnecting with recesses on the underside of the bottom plate.

6. A building set according to claim 5, wherein at least some of the coupling means for interconnecting the rod-shaped elements and the bottom plate coupling means consist of or snap- or friction-locks.

7. A building set according to claim 4, wherein the coupling means for interconnecting the rod-shaped elements are positioned a distance from the corners of the top plane.

8. A building set according to claim 7, wherein the coupling means for interconnecting the rod-shaped elements are provided by either the column or the girders having at one end, two laterally protruding rods whose outer edges are provided with means for engagement with other rod-shaped elements.

9. A building set according to claim 1, wherein the means for releasably receiving the wall elements in the side area of columns (1) comprise wall element coupling means (6) arranged laterally on the columns.

10. A building set according to claim 1, wherein the means for releasably receiving the wall elements in the sides of the building modules are arranged in such a manner that the individual wall element may be removed inwardly as well as outwardly relative to the space defined by the building module.

11. A building set according to claim 10, wherein the means for releasably receiving wall elements in the sides of the building modules are so designed that the individual wall element may be oriented as desired with an outwardly facing facade or an inwardly facing facade when received in the sides of the building modules.

* * * * *